US010314367B2

(12) United States Patent
Kilgore et al.

(10) Patent No.: US 10,314,367 B2
(45) **Date of Patent: *Jun. 11, 2019**

(54) SOLE STRUCTURE FOR AN ARTICLE OF FOOTWEAR WITH EXTENDED PLATE

(71) Applicant: NIKE, Inc., Beaverton, OR (US)

(72) Inventors: Bruce J. Kilgore, Lake Oswego, OR (US); Paul J. Francis, Beaverton, OR (US); Kevin W. Hoffer, Portland, OR (US); Shane S. Kohatsu, Portland, OR (US); Aaron K. Seid, Portland, OR (US); Jeffrey C. Spanks, Portland, OR (US); Andrea M. Vinet, Portland, OR (US); George A. Xanthos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 150 days.

This patent is subject to a terminal disclaimer.

(21) Appl. No.: 15/358,813

(22) Filed: Nov. 22, 2016

(65) Prior Publication Data

US 2017/0071286 A1 Mar. 16, 2017

Related U.S. Application Data

(63) Continuation-in-part of application No. 14/612,971, filed on Feb. 3, 2015, now Pat. No. 9,532,623.
(Continued)

(51) Int. Cl.
*A43C 15/02* (2006.01)
*A43B 5/06* (2006.01)
(Continued)

(52) U.S. Cl.
CPC ..... *A43C 15/02* (2013.01); *A43B 5/06* (2013.01); *A43B 13/122* (2013.01); *A43B 13/14* (2013.01); *A43B 13/183* (2013.01)

(58) Field of Classification Search
CPC ..... A43B 13/02; A43B 13/00; A43B 13/023; A43B 13/026; A43B 13/183;
(Continued)

(56) References Cited

U.S. PATENT DOCUMENTS 427,136 A * 5/1890 Walker ..... A43B 13/183 36/28
510,504 A * 12/1893 Foster ..... A43B 13/20 36/29

(Continued)

*Primary Examiner* — Shaun R Hurley
*Assistant Examiner* — Bao-Thieu L Nguyen
(74) *Attorney, Agent, or Firm* — Quinn IP Law

(57) ABSTRACT

An article of footwear has a sole structure with an extension portion that maintains contact with the ground during a forward stride, extending the time period for deceleration of loads applied to the sole structure. The article of footwear comprises an upper and a sole structure. The upper has a forefoot region with a foremost extent. The sole structure has a forefoot portion underlying the forefoot region, and an extension portion extending forward from the forefoot portion. The extension portion extends forward of the foremost extent of the upper from a forward edge of the forefoot portion to a distal end. A top side of the extension portion is spaced apart from the upper between the forward edge and the distal end. The extension portion establishes a propulsion surface beyond the foremost extent of the upper during a forward stride.

26 Claims, 13 Drawing Sheets

Related U.S. Application Data

(60) Provisional application No. 61/937,068, filed on Feb. 7, 2014.

(51) Int. Cl.
*A43B 13/12* (2006.01)
*A43B 13/14* (2006.01)
*A43B 13/18* (2006.01)

(58) Field of Classification Search
CPC ..... A43B 13/122; A43B 13/28; A43B 13/143; A43B 13/14; A43B 13/42; A43B 13/20; A43B 5/18; A43B 5/06; A43B 5/14; A43B 5/12; A43B 5/00; A43C 15/02
See application file for complete search history.

(56) References Cited

U.S. PATENT DOCUMENTS 1,109,130 A * 9/1914 Kaye ..... A43B 13/20 36/29
1,841,710 A * 1/1932 Byrne ..... A43B 5/18 36/127
2,817,163 A * 12/1957 Clark ..... A43B 13/42 36/17 R
3,463,164 A * 8/1969 Matles ..... A43B 3/30 36/112
3,661,151 A * 5/1972 Schoenbrun ..... A43B 7/00 36/140
4,030,213 A 6/1977 Daswick
4,182,055 A * 1/1980 Turner, Jr. ..... A43B 7/12 36/16
4,186,500 A * 2/1980 Salzman ..... A43B 5/0411 280/615
4,676,009 A * 6/1987 Davis ..... A43B 5/18 36/116
4,811,504 A * 3/1989 Bunke ..... A43B 5/0419 36/132
4,821,432 A * 4/1989 Reiber ..... A43B 7/1465 36/110
4,864,739 A * 9/1989 Maestri ..... A43B 7/142 12/146 M
5,579,591 A * 12/1996 Kousaka ..... A43B 7/14 36/25 R
5,829,172 A * 11/1998 Kaneko ..... A43B 5/06 36/108
6,202,326 B1 * 3/2001 Hauglin ..... A43B 5/0415 36/117.2
6,385,864 B1 * 5/2002 Sell, Jr. ..... A43B 13/181 36/29
6,393,735 B1 * 5/2002 Berggren ..... A43B 5/18 36/129
6,457,976 B1 * 10/2002 Fleshman ..... A43B 3/30 36/103
6,470,599 B1 * 10/2002 Chu ..... A43B 5/003 36/107
7,472,496 B2 * 1/2009 Potter ..... A43B 13/143 36/29
8,522,457 B2 * 9/2013 Scholz ..... A43B 13/141 36/102
8,578,633 B2 * 11/2013 Roether ..... A43B 13/026 36/100
8,601,722 B2 * 12/2013 Frye ..... A43B 3/163 36/140
8,615,900 B2 * 12/2013 Diekman ..... A63B 25/10 36/27
8,992,351 B2 * 3/2015 Manou ..... A63B 71/0009 473/518
9,375,049 B2 * 6/2016 Hazenberg ..... A43B 13/20
9,532,623 B2 * 1/2017 Kilgore ..... A43B 13/14
2002/0026730 A1 * 3/2002 Whatley ..... A43B 13/143 36/132
2004/0064973 A1 * 4/2004 Talbott ..... A43B 5/06 36/25 R
2004/0205983 A1 * 10/2004 Talbott ..... A43B 5/06 36/134
2005/0160625 A1 * 7/2005 Whatley ..... A43B 13/143 36/25 R
2009/0064538 A1 * 3/2009 Roether ..... A43B 13/026 36/88
2010/0192417 A1 * 8/2010 Giovale ..... A43B 5/18 36/116
2011/0131831 A1 6/2011 Peyton et al.
2012/0023784 A1 * 2/2012 Goldston ..... A43B 3/0031 36/137
2013/0192090 A1 * 8/2013 Smith, IV ..... A43B 13/182 36/103
2013/0210536 A1 * 8/2013 Winskowicz ..... A63B 69/3608 473/217
2013/0247422 A1 9/2013 Holt et al.
2014/0360046 A1 * 12/2014 Dojan ..... A43B 13/20 36/29
2016/0174658 A1 * 6/2016 Desmarais ..... A43B 13/14 36/29
2017/0273400 A1 * 9/2017 Penka ..... A43B 13/122

* cited by examiner

SOLE STRUCTURE FOR AN ARTICLE OF FOOTWEAR WITH EXTENDED PLATE

CROSS-REFERENCE TO RELATED APPLICATIONS

This application is a continuation-in-part of and claims the benefit of priority to U.S. application Ser. No. 14/612,971, filed on Feb. 3, 2015, which claims the benefit of priority to U.S. Provisional Application Ser. No. 61/937,068, filed on Feb. 7, 2014, both of which are hereby incorporated by reference in their entireties.

TECHNICAL FIELD

The present teachings generally include a sole structure and an article of footwear having the sole structure.

BACKGROUND

Footwear typically includes a sole configured to be located under a wearer's foot to space the foot away from the ground or floor surface. Sole structure can be designed to provide a desired level of cushioning. Athletic footwear in particular sometimes utilizes polyurethane foam or other resilient materials in the sole structure to provide cushioning. It is also beneficial for the sole structure for an article of athletic footwear to have a ground contact surface that provides sufficient traction and durability for a particular athletic endeavor.

DETAILED DESCRIPTION

Figure 1:
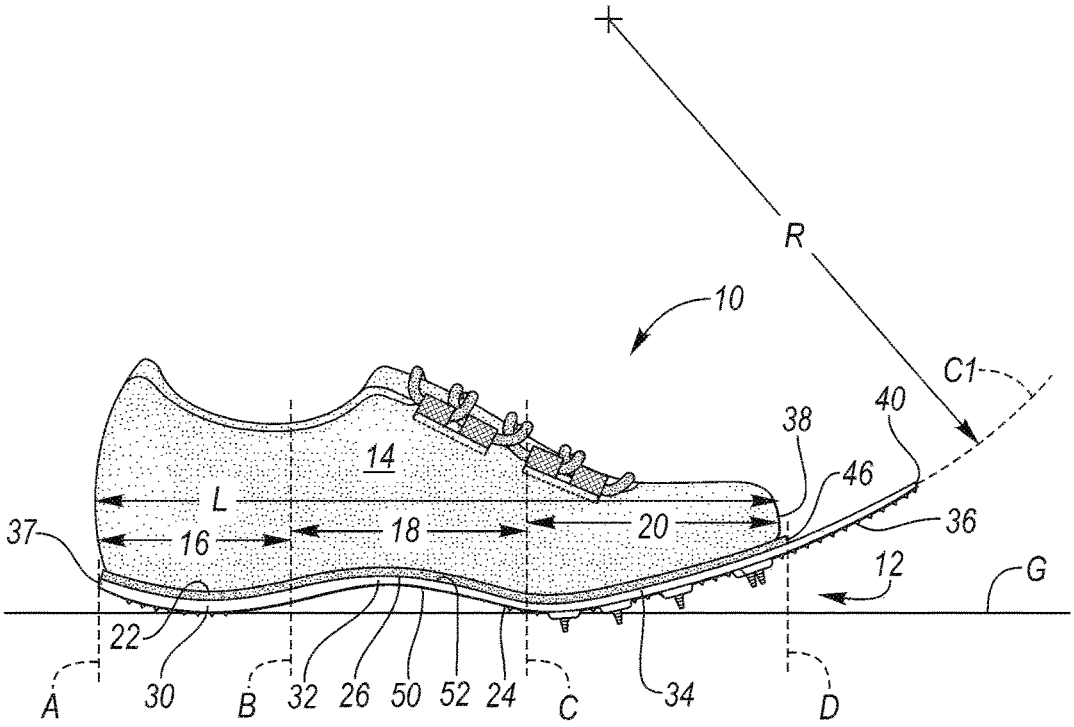
FIG. 1 is a schematic illustration in side view of an article of footwear with a sole structure that has a plate with an extension portion.
Figure 2:
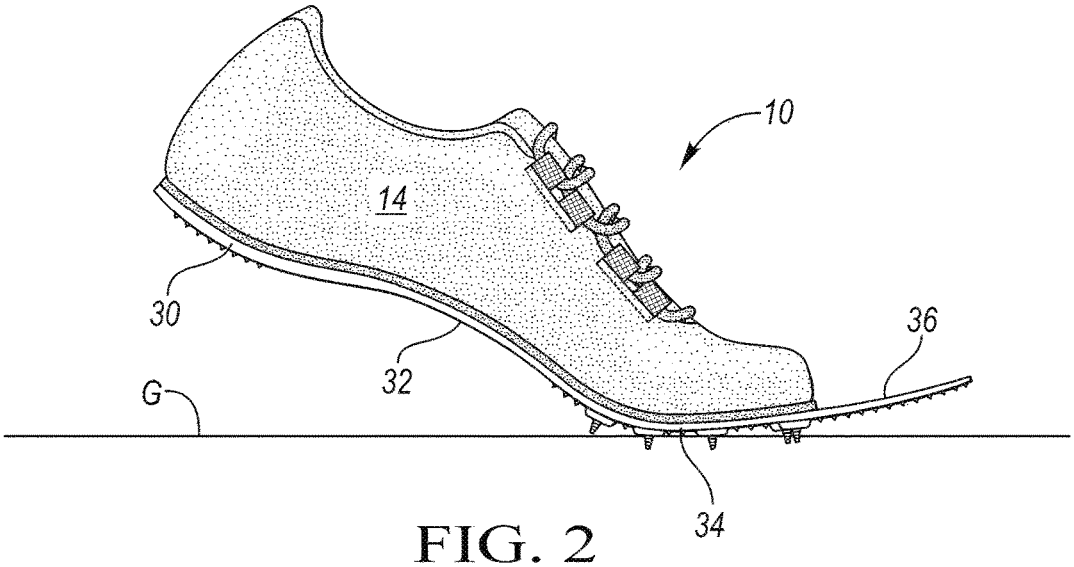
FIG. 2 is a schematic illustration in side view of the article of footwear of FIG. 1 at a first stage of motion.

An article of footwear has a sole structure with an extension portion that provides a surface area for forward propulsion that maintains contact with the ground during a forward stride, extending the time period for deceleration of loads applied to the sole structure. The article of footwear comprises an upper and a sole structure. The upper has a forefoot region with a foremost extent. The sole structure has a forefoot portion underlying the forefoot region of the upper, and an extension portion extending forward from the forefoot portion. The extension portion extends forward of the foremost extent of the upper from a forward edge of the forefoot portion to a distal end, and a top side of the extension portion is spaced apart from the upper between the forward edge of the forefoot portion and the distal end. The extension portion establishes a propulsion surface beyond the foremost extent of the upper during a forward stride.

In an aspect of the disclosure, the forward edge of the forefoot portion has a first width, and the extension portion has a second width greater than the first width. The extension portion thus flares laterally outward relative to the forefoot portion, increasing the surface area of the forefoot portion.

In an aspect of the disclosure, the sole structure includes a resilient sole component disposed between the upper and the extension portion. For example, the resilient sole component may be an elastic foam midsole. The resilient sole component extends forward of the upper on the top side of the extension portion. The extension portion may extend forward beyond a forward-most extent of the resilient sole component. The bladder may extend forward beyond a forward-most extent of the resilient sole component.

The cushioning component may further comprise an outsole underlying the extension portion. The outsole has a ground contact surface that includes the propulsion surface.

Stated differently, the extension portion allows for a greater ground contact surface than a sole structure than terminates at the forefoot portion.

In an embodiment of the disclosure, the sole structure includes a bladder having a fluid-filled chamber disposed at least partially in the extension portion. In one or more embodiments, the bladder may also extend in the forefoot portion, at least partially in the midfoot portion, but not in the heel portion. The bladder may include a tether element that spans the fluid-filled chamber from a lower inner surface of the bladder to an upper inner surface of the bladder.

The bladder may be disposed at least partially in the forefoot portion of the sole structure and may extend laterally outward of a lateral side of the upper in the forefoot region and medially outward of a medial side of the upper in the forefoot region. In addition to underlying the bladder in the extension portion, the outsole underlies the bladder where it extends laterally outward of the upper. Accordingly, in addition to extending the ground contact surface forward of the forefoot portion, the sole structure has increased ground contact surface in the transverse direction.

In an aspect of the disclosure, the sole structure includes an additional plate extending at least partially in the extension portion and disposed adjacent the bladder such that the plate interfaces with the bladder during the forward stride. The additional plate may underlie the bladder and interface with a lower surface of the bladder. The additional plate may overlie the bladder and interfaces with an upper surface of the bladder. There may be two additional plates, a first additional plate that underlies the bladder and interfaces with a lower surface of the bladder, and a second additional plate that overlies the bladder and interfaces with an upper surface of the bladder In an aspect of the disclosure, the extension portion and the forefoot portion have a substantially equal radius of curvature along a length of the sole structure.

In an aspect of the disclosure, the sole structure includes a plate and a resilient sole component. The plate has a top side and a bottom side opposite the top side. The top side is nearer to the upper than the bottom side. The resilient sole component is disposed between the upper and the top side of the plate and extends forward of the foremost extent of the upper. The extension portion establishes a ground-contacting propulsion surface beyond the foremost extent of the upper during a forward stride. The plate may be a bladder having a fluid-filled chamber disposed at least partially in the extension portion.

In an aspect of the disclosure, the forward edge of the forefoot portion has a first width, and the extension portion has a second width greater than the first width.

In an aspect of the disclosure, the sole structure includes an outsole on the bottom side of the plate and underlying the extension portion, and wherein the outsole has a ground contact surface that includes the propulsion surface.

In an aspect of the disclosure, the plate includes a bladder having a fluid-filled chamber disposed at least partially in the extension portion. In an aspect of the disclosure, the bladder includes a tether element spanning the fluid-filled chamber from a lower inner surface of the bladder to an upper inner surface of the bladder.

In an aspect of the disclosure, the bladder is disposed at least partially in the forefoot portion of the sole structure and extends laterally outward of a lateral side of the upper in the forefoot region and medially outward of a medial side of the upper in the forefoot region.

In an aspect of the disclosure, the sole structure has a midfoot portion rearward of the forefoot portion, and a heel portion rearward of the midfoot portion, and the bladder extends only in the midfoot portion, the forefoot portion, and the extension portion.

In an aspect of the disclosure, the sole structure includes an additional plate overlying the bladder. In an aspect of the disclosure, the bladder extends forward beyond a forwardmost extent of the resilient sole component.

In an aspect of the disclosure, the resilient sole component is an elastic foam midsole. In an aspect of the disclosure, the extension portion and the forefoot portion have a substantially equal radius of curvature along a length of the sole structure.

In an aspect of the disclosure, an article of footwear comprises an upper having a forefoot region with a foremost extent, and a sole structure having a forefoot portion underlying the forefoot region of the upper, and an extension portion extending forward from the forefoot portion. The extension portion extends forward of the foremost extent of the upper from a forward edge of the forefoot portion to a distal end, and a top side of the extension portion is spaced apart from the upper between the forward edge of the forefoot portion and the distal end. The extension portion establishes a propulsion surface beyond the foremost extent of the upper during a forward stride.

In an aspect of the disclosure, the sole structure includes a plate extending at least partially in the extension portion adjacent the bladder and interfacing with an outer surface of the bladder. The plate may overlie the bladder and the outer surface may be an upper surface of the bladder. Alternatively, the bladder may overlie the plate and the outer surface may be a lower surface of the bladder. Still further, the plate may be a first plate that overlies the bladder, the outer surface may be a lower surface of the bladder, and the sole structure may include a second plate extending at least partially in the extension portion adjacent the bladder with the bladder overlying the second plate and the second plate interfacing with a lower surface of the bladder.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like components throughout the several views, FIG. 1 shows an article of footwear 10 that has a sole structure 12. The article of footwear 10 may include a footwear upper 14 attached to the sole structure 12 and dimensioned according to a specific size chart for a human foot. As shown, the article of footwear 10 is an athletic shoe, such as for running track and field. In other embodiments, the article of footwear 10 could be a dress shoe, a work shoe, a sandal, a slipper, a boot, or any other category of footwear. The article of footwear 10 has a heel region 16, a midfoot region 18, and a forefoot region 20. The heel region 16 generally includes portions of the article of footwear 10 corresponding with rear portions of a human foot of the size of the article of footwear 10, including the calcaneus bone. The midfoot region 18 generally includes portions of the article of footwear 10 corresponding with an arch area of the human foot of the size of the article of footwear 10. The forefoot region 20 generally includes portions of the article of footwear 10 corresponding with the toes and the joints connecting the metatarsals with the phalanges of the human foot of the size of article of footwear 10.

The sole structure 12 may also be referred to as a sole assembly, as it may include multiple components. For example, the sole structure 12 may include a resilient sole component 22 attached to the footwear upper 14 and positioned under the footwear upper 14 when the sole structure 12 is resting on a level ground plane G. The sole component 22 may be a material that combines a desired level of resiliency and support, such as, in one example, an ethylene vinyl acetate (EVA) foam.

The sole structure 12 includes a plate 24 secured to a first side 26 of the sole component 22 that faces away from the upper 14. The plate 24 has a heel portion 30, a midfoot portion 32, a forefoot portion 34, and an extension portion 36. The heel portion 30, the midfoot portion 32, and the forefoot portion 34 correspond with the heel region 16, the midfoot region 18, and the forefoot region 20, respectively, of the article of footwear 10. The heel portion 30 of the plate 24 is defined as the rear third of the sole structure 12, and is shown in FIG. 1 as extending from a rear distal end 37 of the sole structure 12 at line A to line B. The midfoot portion 32 of the plate 24 is defined as the middle third of the sole structure 12, and is shown in FIG. 1 as extending from line B to line C. The forefoot portion 34 of the plate 24 is defined as the front third of the sole structure 12, and is shown in FIG. 1 as extending from line C to line D. For purpose of example only, lines B and C divide the article of footwear 10 lengthwise into equal thirds.

Figure 5:
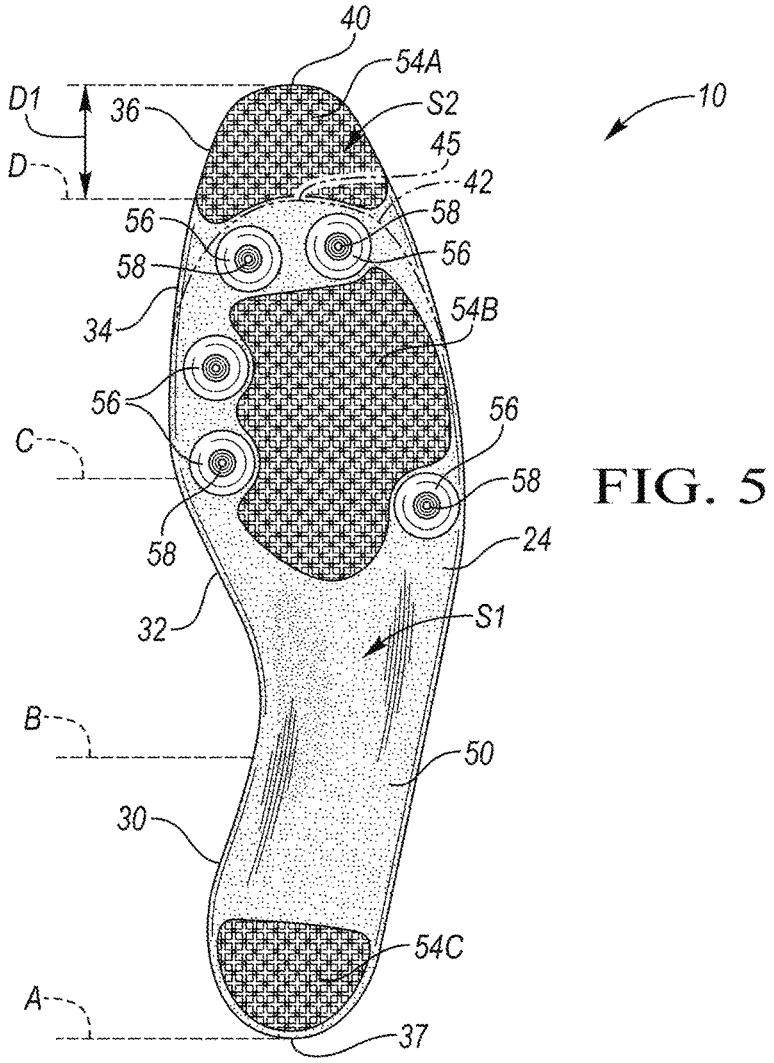
FIG. 5 is a schematic illustration in bottom view of the article of footwear of FIG. 1.

The extension portion 36 of the plate 24 extends from the forefoot portion 34 forward to a front distal end 40 of the article of footwear 10. The extension portion 36 extends further forward than both the sole component 22 and the foremost extent 38 of the upper 14. In the embodiment of FIG. 1, the curvature C1 of the extension portion 36 is the same as the curvature of the forefoot portion 34. In other words, the curvature C1 of the extension portion 36 follows the side profile of the forefoot portion 34, and the extension portion 36 and the forefoot portion 34 have a substantially equal radius of curvature R. As best shown in FIG. 5, the extension portion 36 increases the available surface area of the plate 24 that can be used as a ground contact surface during use of the article of footwear 10. More specifically, a conventional plate for the sole structure 12 would have a forward distal end 45 at a forward edge 42 of the forefoot portion 34 indicated with a phantom line. The forward distal end 45 of the forefoot portion 34 and a forward distal end 46 of the sole component 22 are both at line D. The extension portion 36 extends forward of the forefoot portion 34 by a first distance D1 extending from the forward distal end 45 to the distal front end 40. The first distance D1 may be from 5 percent to 30 percent of the length L from the rear distal end 37 of the heel portion 30 to the forward distal end 45 of the forefoot portion 34. Thus, the conventional plate would have a surface area of surface S1, rearward of forward edge 42. The extension portion 36, however, adds the additional surface area of surface S2 that extends forward of the forward edge 42 of the forefoot portion to the distal front end 40 of the plate 24. The plate 24 thus extends from the rear distal end 37 of the sole structure 12 to the front distal end 40 and has a surface area that is the sum of the surface area of surface S1 and the surface area of surface S2. The rear distal end 37 of the sole structure 12 can also be referred to as the rear distal end of the plate 24.

Figure 3:
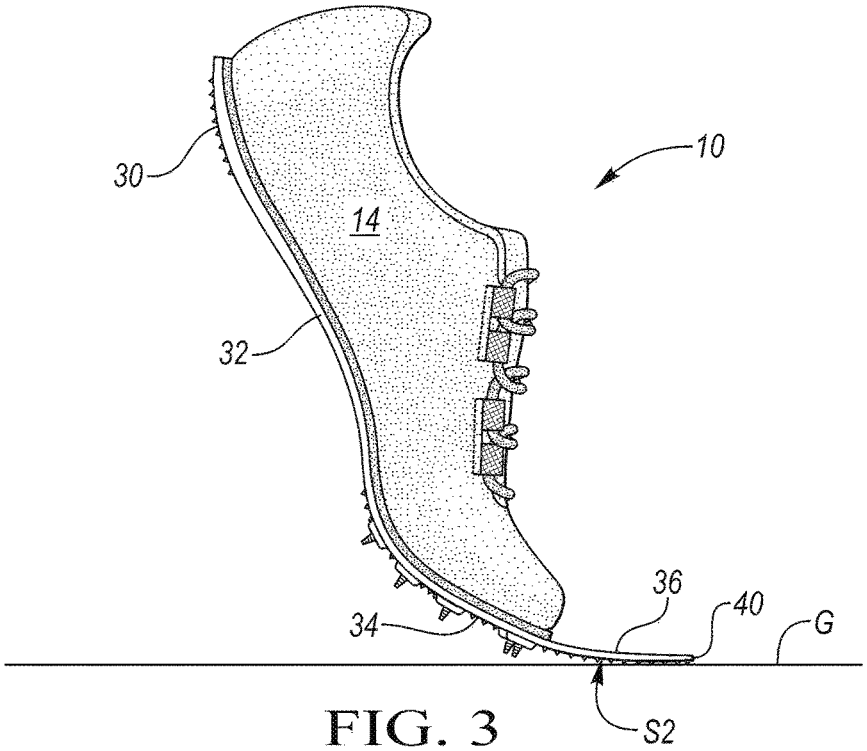
FIG. 3 is a schematic illustration in side view of the article of footwear of FIG. 1 at a second stage of motion.
Figure 4:
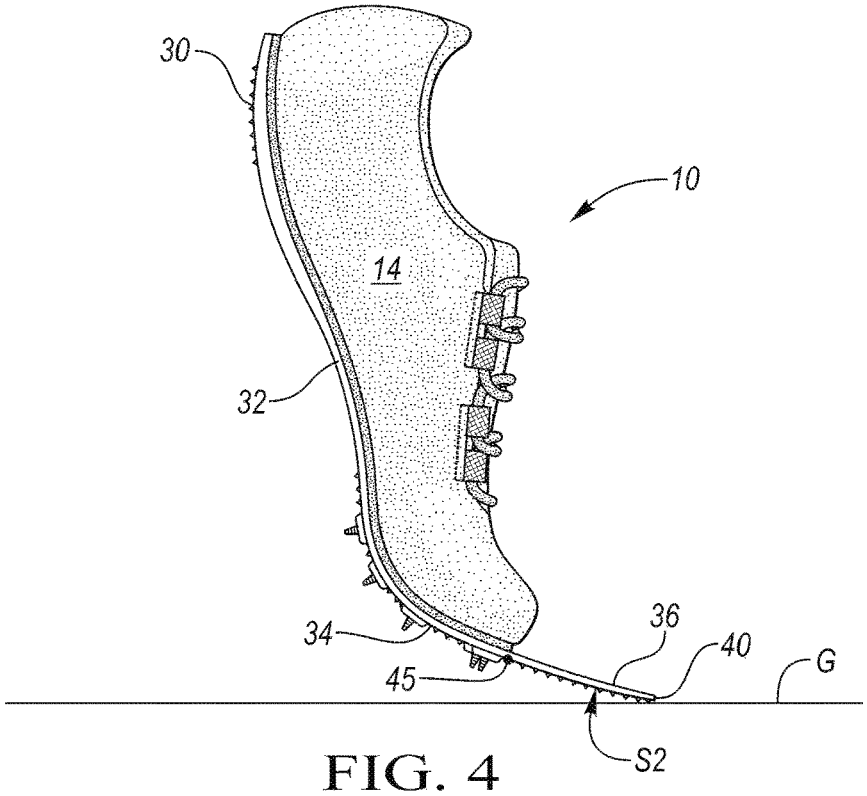
FIG. 4 is a schematic illustration in side view of the article of footwear of FIG. 1 at a third stage of motion.

When the article of footwear 10 is worn for certain activities, such as for track and field or other activities involving running, the article of footwear 10 progresses through the stages of motion in order from FIGS. 1-4. Alternatively, if the wearer's running motion is such that the heel portion 30 does not touch the level ground plane G for a period of time, i.e., remains above the ground surface, then the stages of motion may proceed from the stage of FIG. 2, through the stages of FIGS. 3 and 4, in order. In FIGS. 3 and 4, the stages of motion of the article of footwear 10 are such that the extension portion 36 alone establishes a ground contact surface with the level ground plane G. In fact, only a portion of the surface S2 serves as the ground contact surface during the stages of motion in FIGS. 3-4.

The plate 24 is specifically configured so that the extension portion 36 has a sufficient stiffness to enable the forefoot portion 34, the midfoot portion 32, and the heel portion 30 to be elevated above the level ground plane G while the extension portion 36 lifts from a rear extent of the extension portion 36 (i.e., from the phantom line representing the forward edge 42 at the forward distal end 45 of the forefoot portion) to the front distal end 40 as the article of footwear 10 moves from the stage of motion of FIG. 3 to the stage of motion of FIG. 4. The stiffness of the extension portion 36 is sufficient to support a wearer of the article of footwear 10 in this manner when the article of footwear 10 is subjected to a predetermined range of forces correlated with an expected range of weights of the wearer of the article of footwear 10. The stiffness of the extension portion 36 allows the article of footwear 10 to effectively pivot forward during the stage of motion in FIG. 4 about the front distal end 40 rather than pivoting about a forward distal end 45 of the forefoot portion 34, as would be the case with a conventional plate.

To achieve the requisite stiffness to enable the extension portion 36 to function as described while at the same time limiting added weight, the plate 24 may be formed of a composite material. Examples of composite materials include, but are not limited to fiber-reinforced composite materials (including short fiber-reinforced materials and continuous fiber-reinforced materials), fiber-reinforced polymers (including carbon-fiber reinforced plastic and glass-reinforced plastic), carbon nanotube reinforced polymers, as well as any other type of composite materials known in the art.

Figure 6:
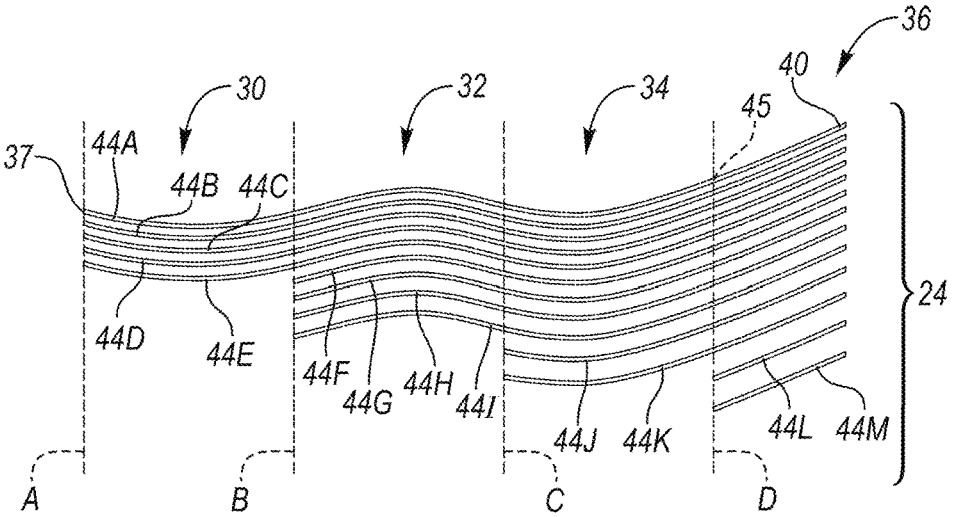
FIG. 6 is a schematic illustration in exploded side view of the plate of FIG. 1.

In one embodiment, shown in FIG. 6, the plate 24 is made of multiple layers of composite material, such as multiple layers 44A-44M of carbon-reinforced plastic. More specifically, the layers are of different lengths from the rear distal end 37 to the front distal end 40. Five of the layers 44A-44E extend the entire length of the plate 24. Four of the layers 44F-44I extend only in the midfoot portion 32, the forefoot portion 34, and the extension portion 36. Two of the layers 44J-44K extend only in the forefoot portion 34 and the extension portion 36. Two of the layers 44L-44M extend only in the extension portion 36. Accordingly, in the embodiment shown, the heel portion 30 has five layers, the midfoot portion 32 has nine layers, the forefoot portion 34 has eleven layers, and the extension portion 36 has thirteen layers. In one embodiment, the layers 44A-44M are each of substantially the same thickness and are of the same composite material. The heel portion 30 thus has a first stiffness, the midfoot portion 32 has a second stiffness, the forefoot portion 34 has a third stiffness, and the extension portion 36 has a fourth stiffness. The fourth stiffness is greater in magnitude than the third stiffness, which is greater in magnitude than the second stiffness, which is greater in magnitude than the first stiffness. Each stiffness has a related spring constant and/or other spring characteristic. Thus, the graduated stiffness of the plate 24 in the lengthwise direction, allows the extension portion 36 to have minimal flexing relative to the forefoot portion 34 as the article of footwear 10 rolls forward on the plate 24 from the heel portion 30 to the extension portion 36. The added length of the extension portion 36, and the associated added surface area of surface S2 forward of the forefoot portion 34 relative to a conventional plate effectively enables the plate 24 to provide a propulsion surface at the front of the article of footwear 10 equivalent to that of an article of footwear for a much larger size foot, such that the extension portion 36 acts as a lever.

Referring again to FIG. 5, the plate 24 has a bottom side 50 that generally faces the level ground plane G and is configured to serve as the ground contact surface. The bottom side 50 is shown in FIG. 1 opposite a top side 52 of the plate 24. The sole component 22 is attached to the top side 52 of the plate 24. The bottom side 50 is also referred to herein as a first side, and the top side 52 is also referred to herein as the second side. Several traction elements 54A, 54B, 54C are secured to the bottom side 50. A first traction element 54A is secured to the bottom side 50 at the extension portion 36. One or more additional traction elements may be secured to the plate 24 at other locations. For example, a second traction element 54B is secured to the bottom side 50 at the forefoot portion 34, and extends partially on the midfoot portion 32 of the plate 24. A third traction element 54C is secured to the bottom side 50 at the heel portion 30. The traction elements 54A-54C can be secured to the bottom side 50 by any suitable means such as by the use of adhesives or thermal bonding, depending on the material of the traction elements 54A-54C and of the plate 24.

The plate 24 is generally smooth on the bottom side 50, and has a relatively low first coefficient of friction. The traction elements 54A-54C are configured with a second coefficient of friction greater than the first coefficient of friction. For example, the plate 24 can be a composite material as discussed herein, and the traction elements 54A-54C can be rubber. Thus, the traction elements 54A-54C provide increased grip of the sole structure 12 to the level ground plane G that prevents the sole structure 12 from slipping relative to the level ground plane G during the phases of motion in FIGS. 1-4. The traction elements 54A-54C also minimize lateral rotation of the sole structure 12 relative to the level ground plane G during wear. For example, when the article of footwear 10 is used during running around a curved track, each stride forward by the runner requires some lateral force to be imparted on the sole structure 12. By increasing traction, the traction elements 54A-54C prevent the lateral force from causing the sole structure 12 to turn clockwise or counterclockwise about a vertical axis through the plate 24 as the lateral force is reacted through one or more of the traction elements 54A-54C. FIG. 5 shows that the plate 24 has molded mounts 56 configured to retain spikes 58 that serve as additional traction elements. The traction elements 54A, 54B, 54C are shown as discontinuous from one another. In other embodiments, the traction elements 54A, 54B and/or 54C can be interconnected, or fewer or more similar traction elements can be secured to other areas of the bottom side 50.

In the embodiment of FIGS. 1-8, the plate 24 serves as an outsole of the article of footwear 10, as it at least partially establishes the ground contact surface S1, S2. In other embodiments within the scope of the present teachings, the plate 24 may be positioned elsewhere within the sole structure 12 or within other embodiments of sole structure while still providing the functions described herein with respect to plate 24. For example, an alternative plate could be positioned within a midsole, such as between layers of a midsole. Still further, an alternative plate could be positioned between an outsole and a midsole. In such embodiments, additional components of the sole structure, such as one or more midsole layers or an outsole, would extend with the plate 24 forward of the foremost extent 38 of the upper 14. Additionally, in any embodiment, an alternative plate could be multiple components and/or could extend rearward from the extension portion only to the forefoot portion (i.e., so the plate included only an extension portion and a forefoot portion), only to the midfoot portion (i.e., so the plate included only an extension portion, a forefoot portion, and a midfoot portion), or all of the way to the heel portion (i.e., so the plate included an extension portion, a forefoot portion, a midfoot portion, and a heel portion).

Figure 7:
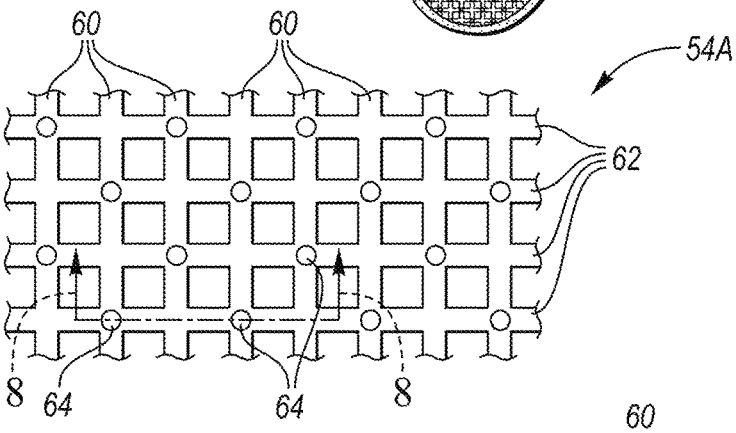
FIG. 7 is a schematic illustration in fragmentary plan view of a traction element also shown secured to the plate of the article of footwear in FIG. 5.
Figure 8:
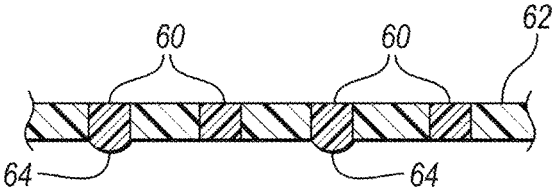
FIG. 8 is a schematic illustration in cross-sectional view of the traction element of FIG. 7 taken at lines 8-8 in FIG. 7.

The traction elements 54A-54C are shown with one example configuration referred to as a lattice pattern. As best shown in FIG. 7, the lattice pattern of a portion of traction element 54A has a first set of substantially parallel elongated strips 60 extending in a first direction, and a second set of substantially parallel elongated strips 62 extending in a second direction substantially perpendicular to the first direction. As used herein, the strips 60 are substantially parallel to one another if adjacent ones of the strips 60 extend lengthwise at less than a 5 percent angle from one another, and the strips 62 are substantially parallel to one another if adjacent ones of the strips 62 extend lengthwise at less than a 5 percent angle from one another. As used herein, the strips 60 are substantially perpendicular to the strips 62 if the strips 60 extend lengthwise at an angle to the strips 62 of between 85 to 95 degrees. The traction element 54A can be configured so that the strips 60, 62 are molded to one another, or the strips 60, 62 can be adhered to one another. FIGS. 7 and 8 show that the traction element 54A has nubs 64 that extend outward from the strips 60, 62. For example, the nubs 64 extend downward toward the level ground plane G in FIG. 1. The nubs 64 can be the same material as the strips 60, 62, or can be a different material, that may be a harder or softer material than the material of the strips 60, 62. The nubs 64 extend from alternating intersections of the strips 60, 62 in a repeating pattern in FIG. 7. The traction elements 54A-54C could be configured in other patterns or in other arrangements than that shown, and additional or fewer traction elements can be used.

Figure 9:
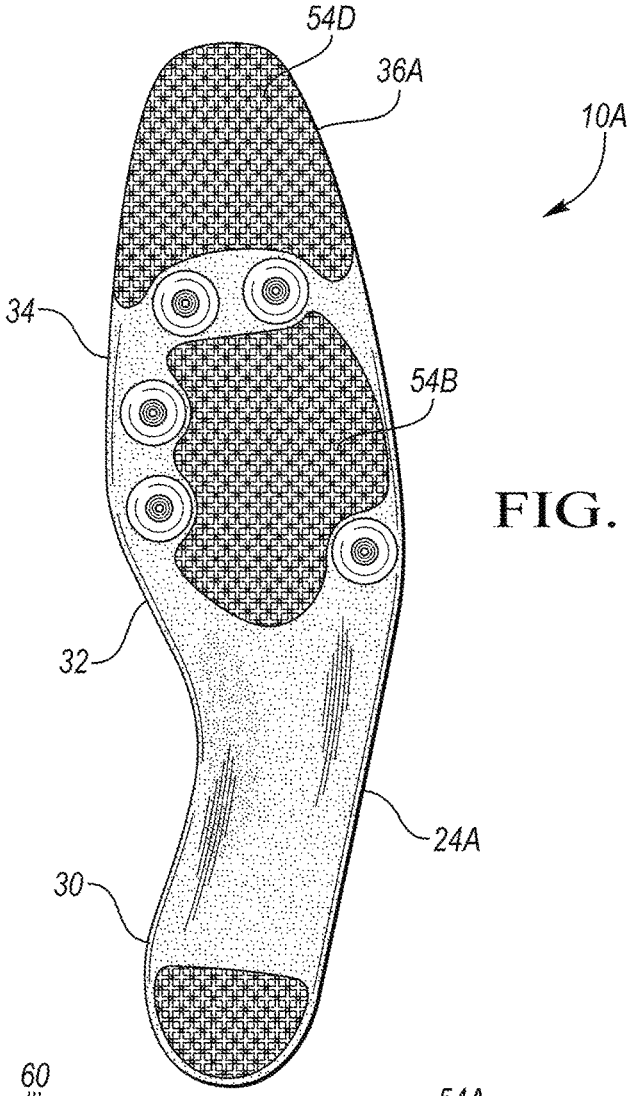
FIG. 9 is a schematic illustration in bottom view of an article of footwear having a plate with an alternative extension portion.
Figure 10:
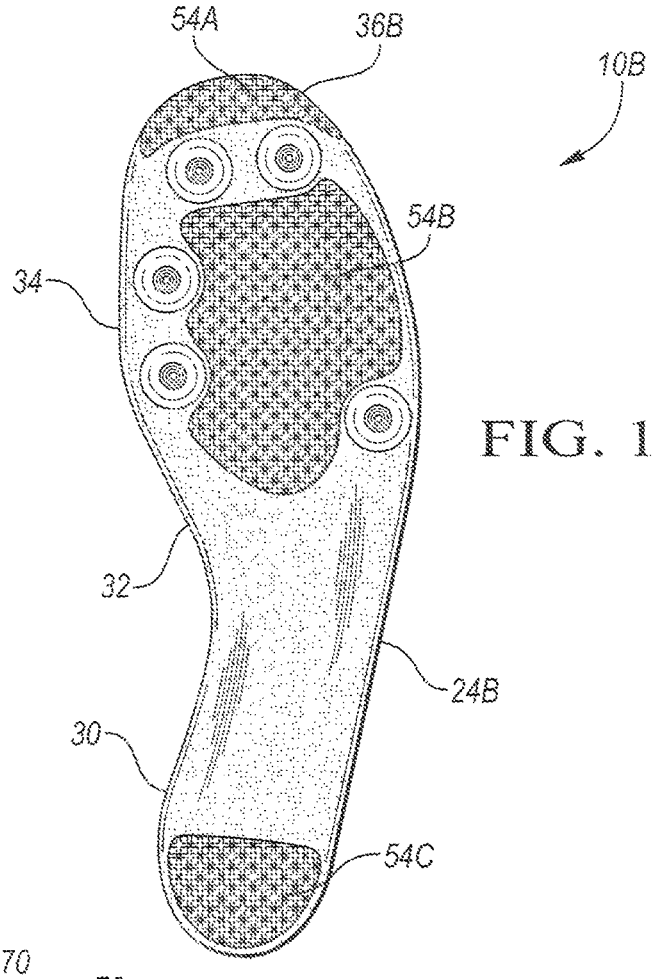
FIG. 10 is a schematic illustration in bottom view of an article of footwear having a plate with another alternative extension portion.

FIG. 9 shows an alternative article of footwear 10A alike in all aspects to the article of footwear 10 shown and described with respect to FIGS. 1-8, except having a plate 24A that has a longer extension portion 36A than the extension portion 36. A first traction element 54D is accordingly longer than first traction element 54A. The plate 24A is otherwise alike in all aspects to plate 24. FIG. 10 shows an alternative article of footwear 10B alike in all aspects to the article of footwear 10 shown and described with respect to FIGS. 1-8, except having a plate 24B that has a shorter extension portion 36B than the extension portion 36 and a first traction element 54E accordingly longer than first traction element 54A. The plate 24B is otherwise alike in all aspects to plate 24. By way of non-limiting example, a comparison of the extension portions 36, 36A, 36B of FIGS. 1, 9, and 10 shows that the extension portion used can extend from 5 percent to 30 percent of the length L of the plate 24, 24A, or 24B, where the length L extends from the rear distal end 37 to the front distal end 45 of a conventional plate. The length L, indicated in FIG. 1, is also the distance from A to D.

Figure 11:
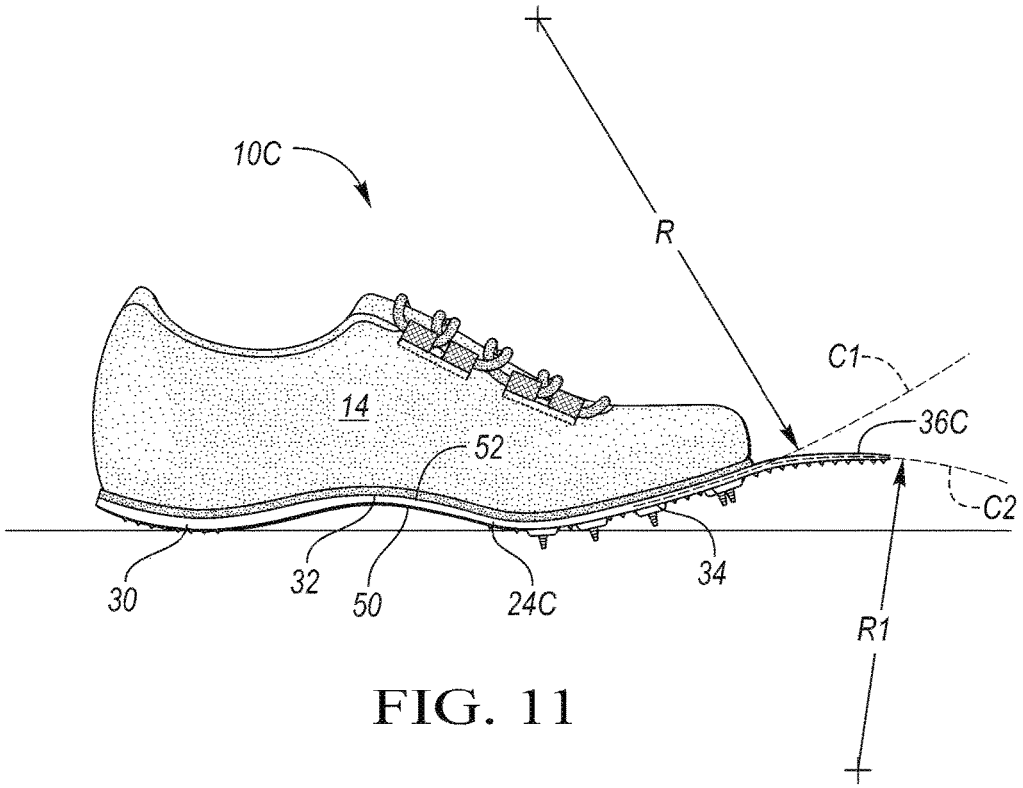
FIG. 11 is a schematic illustration in side view of an article of footwear having a plate with an alternative extension portion.

FIG. 11 shows another alternative embodiment of an article of footwear 10C that is alike in all aspects to the article of footwear 10 shown and described with respect to FIGS. 1-8, except having a plate 24C that has an extension portion 36C with a curvature C2 different than the curvature C1 of the forefoot portion 34. The plate 24D is otherwise alike in all aspects to plate 24. The curvature C1 following the profile of the forefoot portion 34 has a radius of curvature R that falls above the second side 52 of the plate 24C, while the curvature C2 of the extension portion 36C has a radius of curvature R1 that falls below the first side 50 of the plate 24C. Additionally, the radius of curvature R1 is smaller than the radius of curvature R.

Figure 12:
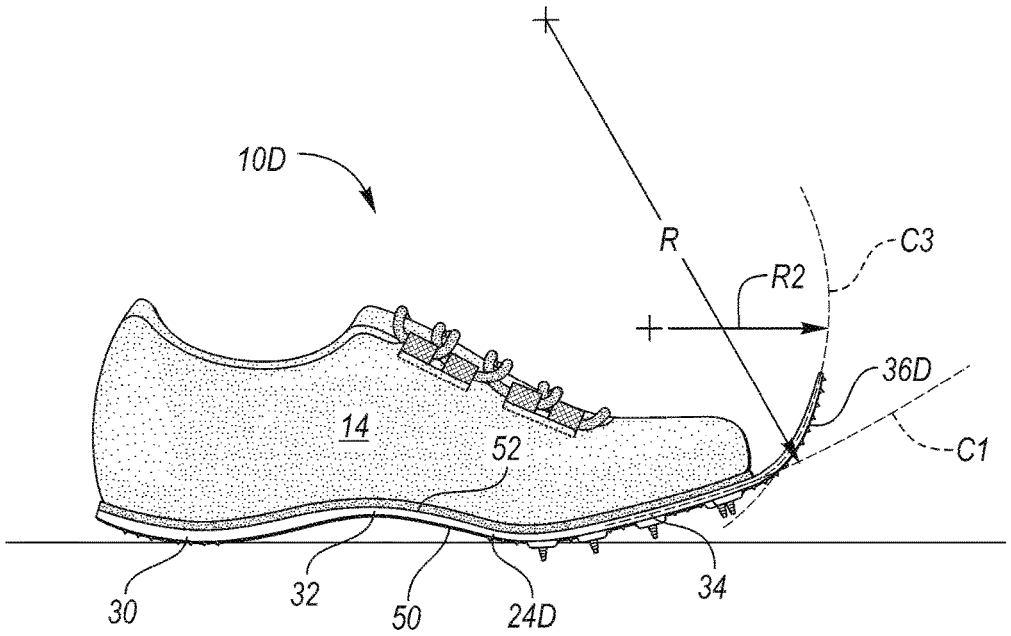
FIG. 12 is a schematic illustration in side view of an article of footwear having a plate with another alternative extension portion.

FIG. 12 shows another alternative embodiment of an article of footwear 10D that is alike in all aspects to the article of footwear 10 shown and described with respect to FIGS. 1-8, except having a plate 24D that has an extension portion 36D that has a curvature C3 different than the curvature C1 of the forefoot portion 34. The plate 24D is otherwise alike in all aspects to plate 24. The curvature C1 following the profile of the forefoot portion 34 has a radius of curvature R that falls above the second side 52 of the plate 24D. The curvature C3 of the extension portion 36D has a radius of curvature R2 that also falls above the second side 52 of the plate 24D, but the radius of curvature R2 is smaller than the radius of curvature R.

Figure 13:
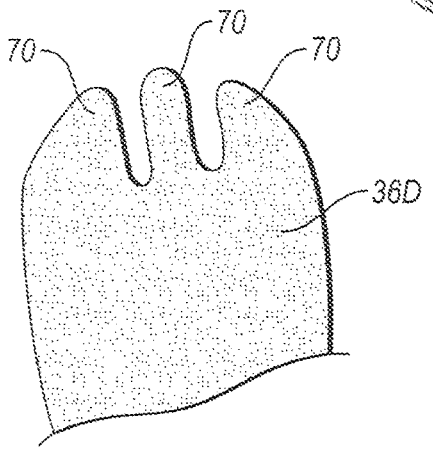
FIG. 13 is a schematic illustration in fragmentary plan view of another alternative extension portion for the plate of FIG. 1.
Figure 14:
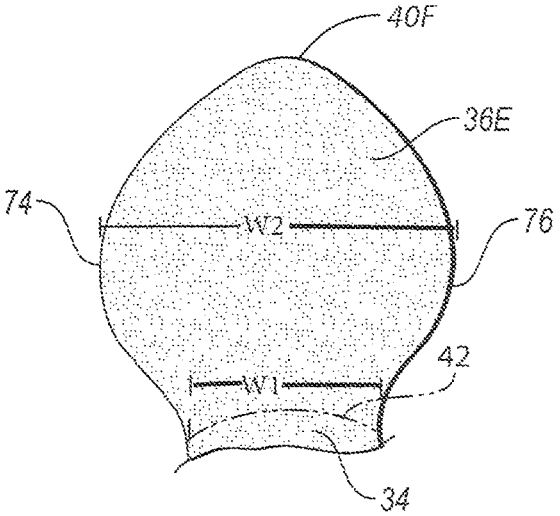
FIG. 14 is a schematic illustration in fragmentary plan view of another alternative extension portion for the plate of FIG. 1.

FIG. 13 shows a fragmentary plan view of a bottom side of a different extension portion 36E that can be used with the plate 24 as an alternative to the extension portion 36. The extension portion 36E has a plurality of fingers 70 having different shapes. FIG. 14 shows a fragmentary plan view of a bottom side of another different extension portion 36F that can be used with the plate 24 as an alternative to the extension portion 36. The extension portion 36F flares outward laterally relative to the forefoot portion 34. Specifically, the extension portion 36F flares outward both on a lateral side 74 and on a medial side 76. The flared extension portion 36F provides enhanced lateral stability. As used herein, a lateral side of a component for an article of footwear, such as lateral side 74 of the extension portion 36E, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for an article of footwear 10, such as medial side 76 of the extension portion 36E, is the side that corresponds with an inside area of the foot of the wearer and is generally closer to the other foot of the wearer (i.e., the side closer to the hallux of the foot of the wearer). The hallux is commonly referred to as the big toe. The forefoot portion 34 has a first width W1 at the forward edge 42, and the extension portion 36F has a second width W2 greater than the first width W1. The second width W2 is shown as the greatest width of the extension portion 36E, as the extension portion 36F varies in width, first increasing in width from the forward edge 42 to the greatest width W2, then decreasing in width to a front distal end 40F of the extension portion 36F, which is also the front distal end of the article of footwear that includes the plate 24.

FIGS. 15-22 show another alternative embodiment of an article of footwear 110 that is alike in many aspects to the article of footwear 10 shown and described with respect to FIGS. 1-8. Features and components that are identical to those of the article of footwear 10 are indicated with like reference numbers. The article of footwear 110 has a sole structure 112 and may include a footwear upper 114 attached to the sole structure 112. In the embodiment shown, the upper 114 is knit in one or more pieces that may be sewn together at seams such as seam 115 shown in FIG. 18.

Figure 19:
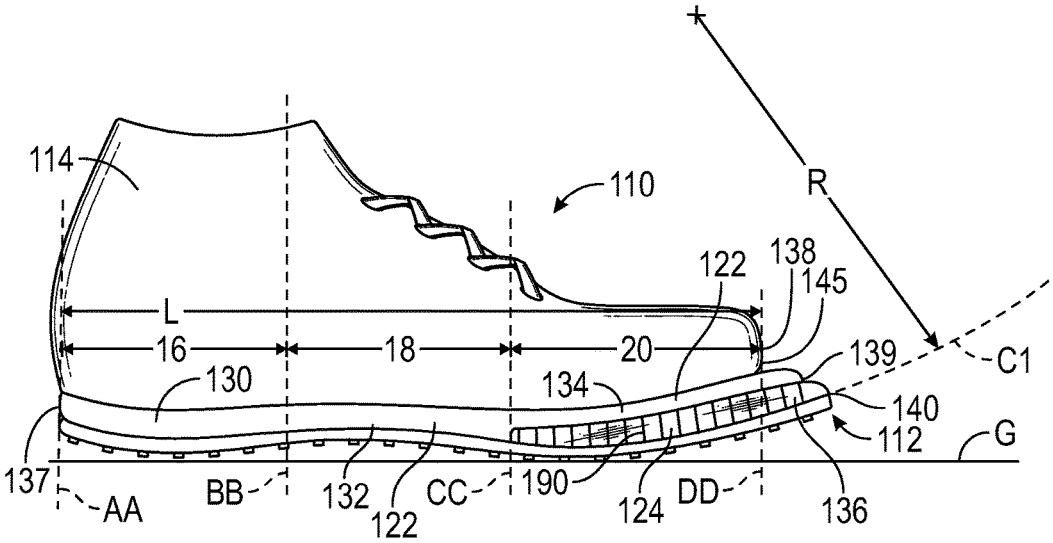
FIG. 19 is a schematic illustration in side view of the article of footwear of FIG. 15.

The sole structure 112 has a heel portion 130, a midfoot portion 132, a forefoot portion 134, and an extension portion 136 as best shown in FIG. 19. The heel portion 130, the midfoot portion 132, and the forefoot portion 134 correspond with the heel region 16, the midfoot region 18, and the forefoot region 20, respectively, of the article of footwear 110. The heel portion 130 of the sole structure 112 is defined as the rear third of the sole structure 112, and is shown in FIG. 19 as extending from a rear distal end 137 of the sole structure 112 at line AA to line BB. The midfoot portion 132 of the sole structure 112 is defined as the middle third of the sole structure 112, and is shown in FIG. 19 as extending from line BB to line CC. The forefoot portion 134 of the sole structure 112 is defined as the front third of the sole structure 112, and is shown in FIG. 19 as extending from line CC to line DD. For purpose of example only, lines BB and CC divide the article of footwear 110 lengthwise into equal thirds.

The extension portion 136 of the sole structure 112 includes a resilient sole component 122 secured to the footwear upper 114, and a bladder 124. Both the resilient sole component 122 and the bladder 124 extend in the extension portion 136. In the embodiment of FIG. 19, the bladder 124 also extends in the midfoot portion 132, and the resilient sole component 122 extends in the midfoot portion 132 and the heel portion 130. For example, in FIG. 18, the resilient sole component 122 is an elastic foam midsole. The upper 114 is secured to a top side 125 (i.e., a top surface) of the resilient sole component 122. The bladder 124 is secured to a bottom side 126 (i.e., a bottom surface) of the resilient sole component 122 that faces away from the upper 114. Stated differently, the resilient sole component 122 overlies the bladder 124. A top side 152 (i.e., a top surface) of the bladder 124 is secured to the bottom side 126 of the resilient sole component 122, such as by thermal bonding or adhesive.

Figure 15:
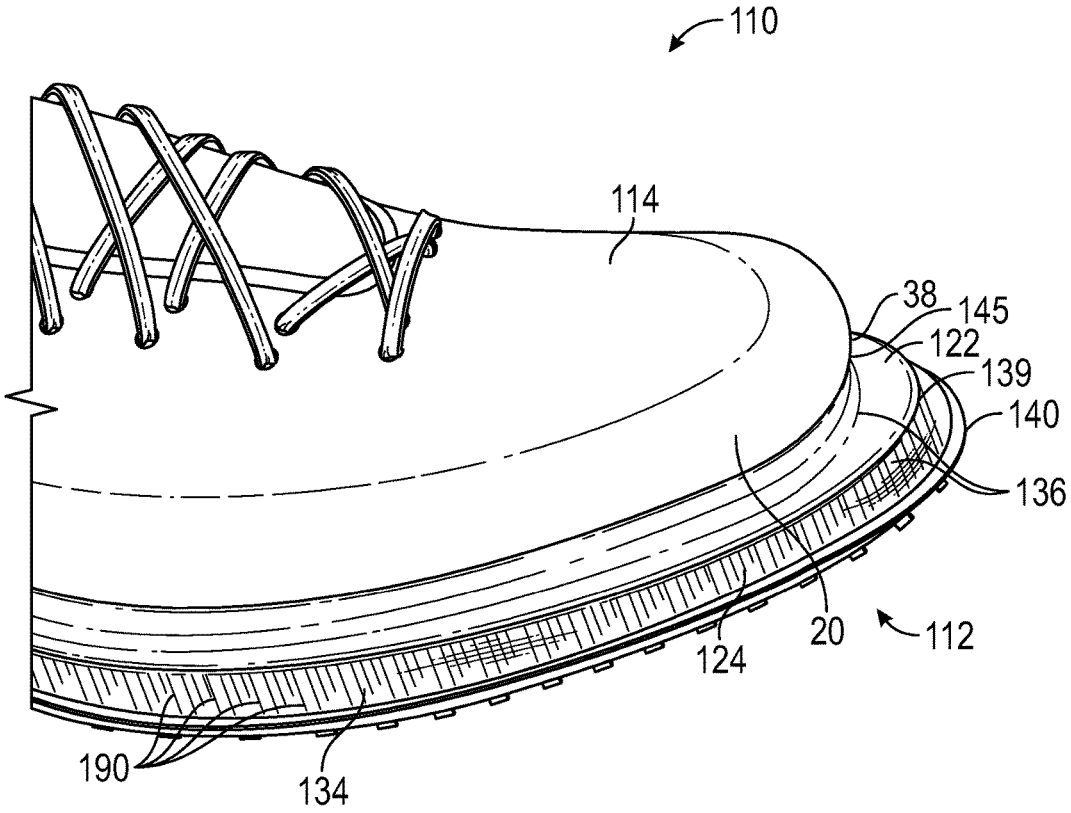
FIG. 15 is a schematic illustration in fragmentary side perspective view of an article of footwear with a sole structure that has an extension portion.
Figure 16:
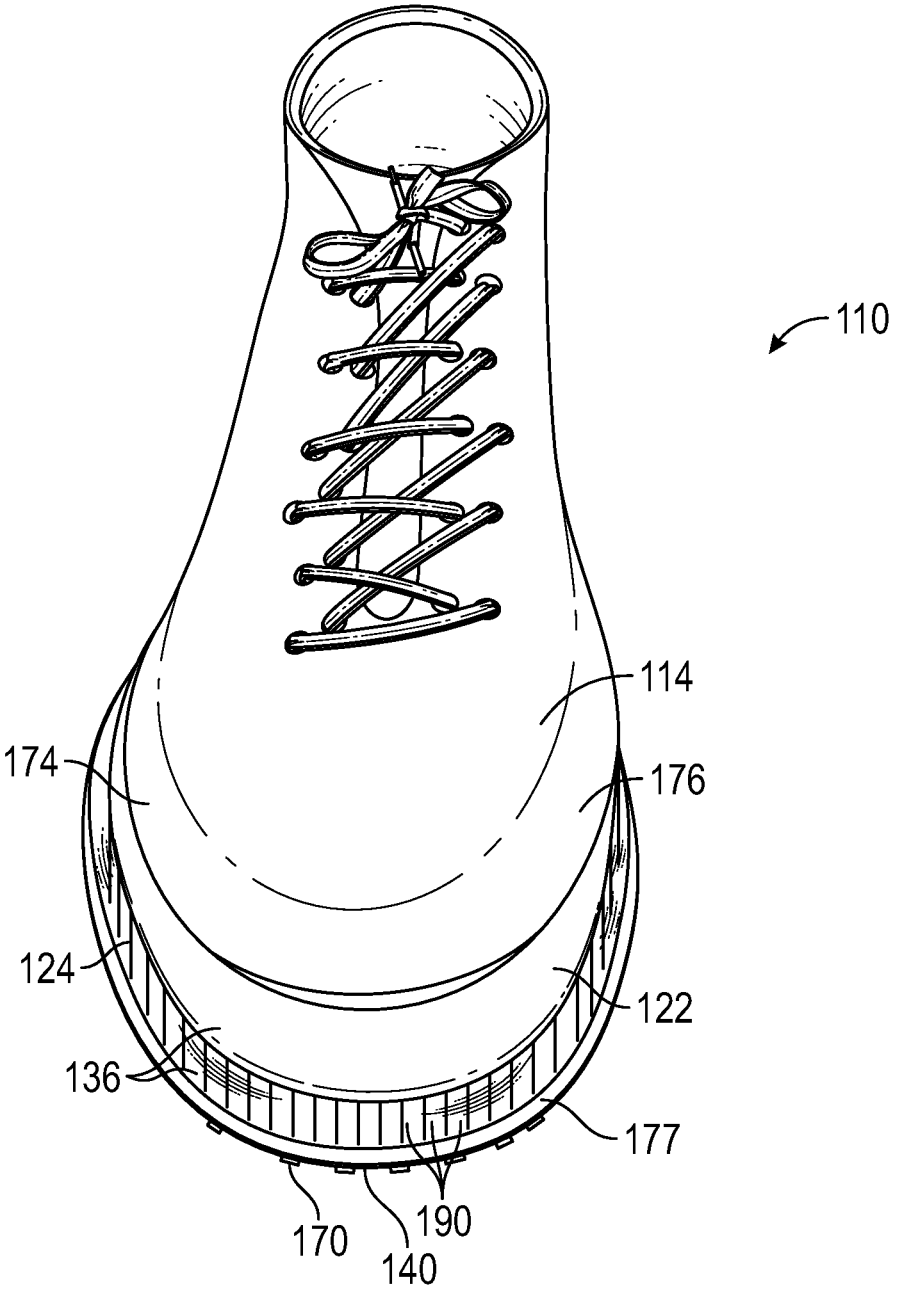
FIG. 16 is a schematic illustration in front perspective view of the article of footwear of FIG. 15.
Figure 17:
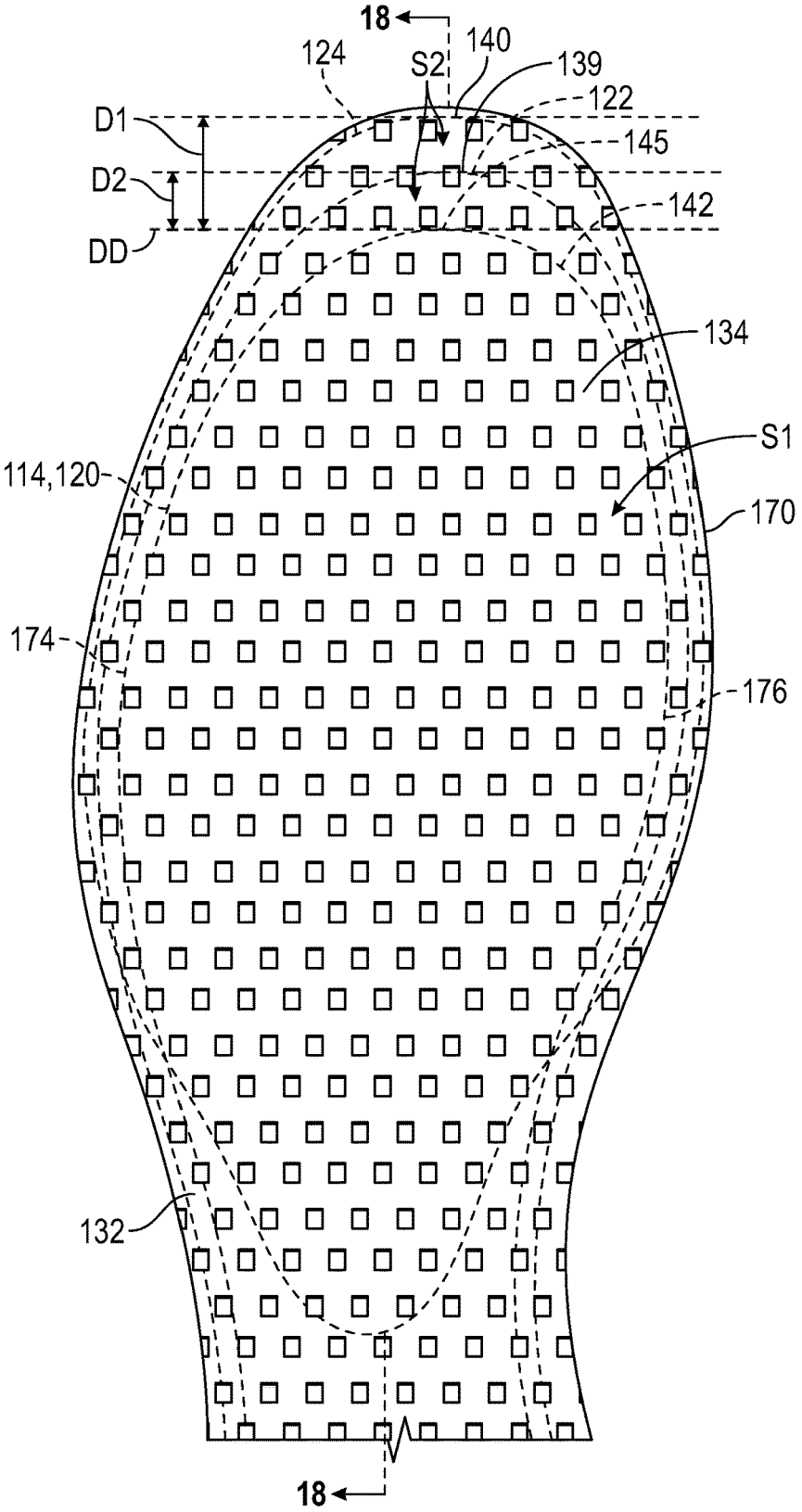
FIG. 17 is a schematic illustration in fragmentary bottom view of the article of footwear of FIG. 15.

As is evident in FIGS. 15-17, the top side of the extension portion 136 (which is the top side 125 of the resilient sole component 122) is spaced apart from the upper 114 between the forward edge 142 of the forefoot portion 20 and the distal end 140. Both the top side 125 of the resilient sole component 122 and the top side 152 of the bladder 124 are spaced apart from the upper 114.

The forefoot portion 134 of the sole structure 112 underlies the forefoot region 120 of the upper 114. The extension portion 136 extends forward from the forefoot portion 134. More specifically, the extension portion 136 extends forward of the foremost extent 138 of the upper 114 from a forward edge 142 of the forefoot portion 134 to a distal end 140. The forward edge 142 of the forefoot portion 134 is indicated with a phantom line in FIG. 17 and represents where a forward edge of a sole structure 112 without an extension portion 136 would lie and corresponds with the foremost extent 138 of the upper 114 in the embodiment shown. The forefoot portion 134 has a forward distal end 145 which falls along the forward edge 142 and is a forward-most extent of the forefoot portion 134. The forward distal end 145 of the forefoot portion 134 is at line DD. The bladder 124 extends forward of the forward distal end 145 of the forefoot portion 134 by a first distance D1 to a distal front end 140. In one or more embodiments, the first distance D1 may be from about 2 percent to 30 percent of the length L from the rear distal end 137 of the heel portion 130 to the forward distal end 145 of the forefoot portion 134 shown in FIG. 19. For example, the first distance D1 may be 2 percent, 3 percent, 4 percent, 5 percent, 6 percent, 7 percent, 8 percent, 9 percent, 10 percent, 11 percent, 12 percent, thirteen percent, 14 percent, 15 percent 16 percent, 17 percent, 18 percent, 19 percent, 20 percent, 21 percent, 22 percent, 23 percent, 24 percent, 25 percent, 26 percent, 27 percent, 28 percent, 29 percent, or 30 percent. In some embodiments, the first distance D1 may be from about 5 percent to about 30 percent of the length L. For example, in one embodiment in which the length L is about 300 millimeters, the first distance D1 may be about 2 millimeters.

The resilient sole component 122 also extends forward of the forward distal end 145 of the forefoot portion 134 to a foremost extent 139, but by a second distance D2 that is less than the first distance D1. Stated differently, the bladder 124 extends forward of the resilient sole component 122. Thus, a sole structure without an extension portion 136 would have a surface area of surface S1, rearward of forward edge 142. The extension portion 136, however, adds the additional surface area of surface S2 that extends forward of the forward edge 142 to the distal front end 140. The sole structure 112 thus extends from the rear distal end 137 to the front distal end 140 and has a surface area that is the sum of the surface area of surface S1 and the surface area of surface S2.

The bottom side 150 of the bladder 124 generally faces the level ground plane G. The bottom side 150 is also referred to herein as a first side, and the top side 152 is also referred to herein as the second side. The sole structure 112 includes an outsole 170 that is secured to the bottom side 150 and includes traction elements 154. The outsole 170 extends under the heel portion 130, the midfoot portion 132, the forefoot portion 134, and the extension portion 136, and has a ground-contact surface S1, S2 that includes the surfaces S1, S2. The outsole 170 is thus configured to serve as the ground contact surface of the sole structure 112. The extension portion 136 includes the surface S2, and thus establishes a propulsion surface beyond the foremost extent 138 of the upper 114 during a forward stride, as is described with respect to FIGS. 19-22. The additional surface S2 extends the amount of time that the outsole 170 is in contact with the ground during a forward stride relative to a sole structure that ends at the forefoot portion (i.e., at forward edge 142), thus extending the amount of time for deceleration and cushioning of the sole structure 112 relative to a ground impact.

Referring to FIG. 17, the outer periphery of the bladder 124 is indicated with dashed lines. The outer periphery of the bladder 124 corresponds with the outer periphery of the outsole 170 in the extension portion 136 and in the forefoot portion 134. The bladder 124 extends in the midfoot portion 134 as well, but tapers inward of the outer periphery of the outsole 170, as is shown in FIG. 17. The outer periphery of the upper 114 is also indicated with dashed lines in FIG. 17. FIGS. 16 and 17 show that the bladder 124 extends laterally outward of a lateral side 174 of the upper 114 in the forefoot region 120, and medially outward of a medial side 176 of the upper 114 in the forefoot region 120. The outsole 170 extends under the bladder 124 from a lateral side to a medial side of the bladder, and thus presents greater ground contact surface than a sole structure that extends only the width of the upper 114 in the forefoot region 120. The bladder 124 and outsole 170 thereunder thus increase ground-contact area in the lateral and medial directions as well as in a forward direction.

Figure 18:
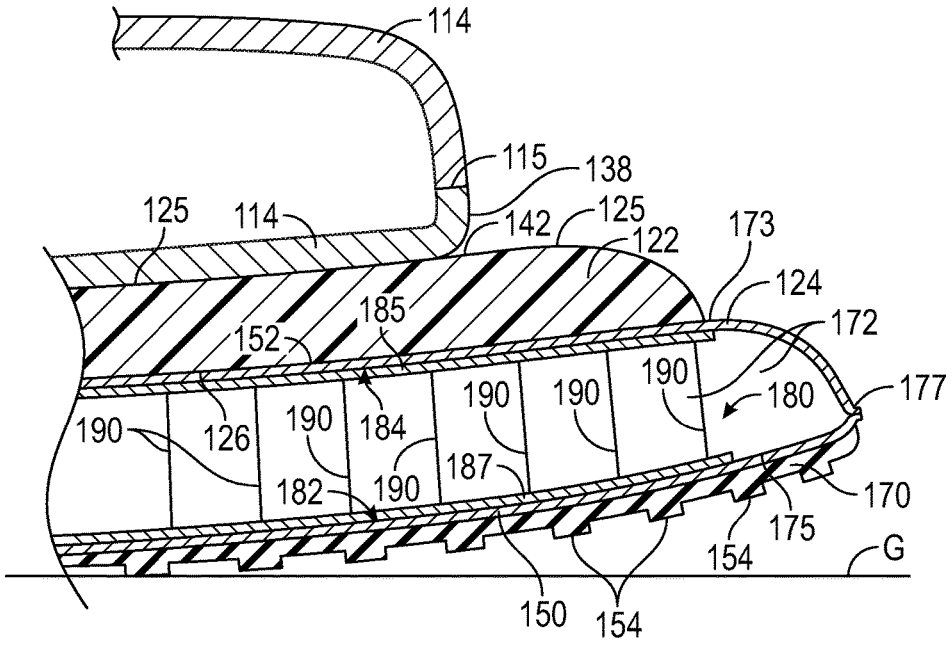
FIG. 18 is a schematic illustration in fragmentary cross-sectional view of the article of footwear of FIG. 15 taken at lines 18-18 in FIG. 17.

Referring to FIG. 18, the bladder 124 includes a polymeric housing 173, 175 defining and enclosing a fluid-filled chamber 172 disposed at least partially in the extension portion 136 (i.e., that portion forward and/or transversely outward of the forward edge 142 in FIG. 17). The polymeric housing 173, 175 includes a top polymeric sheet 173 and a bottom polymeric sheet 175 bonded to one another at a peripheral flange 177 that at least partially creates a seal for the chamber 172. The polymeric sheets 173, 175 can be formed from a variety of materials including various polymers that can resiliently retain a fluid such as air or another gas. Examples of polymer materials for polymeric sheets 173, 175 include thermoplastic urethane, polyurethane, polyester, polyester polyurethane, and polyether polyurethane. Moreover, the polymeric sheets 173, 175 can each be formed of layers of different materials. In one embodiment, each polymeric sheet 173, 175 is formed from thin films having one or more thermoplastic polyurethane layers with one or more barriers layer of a copolymer of ethylene and vinyl alcohol (EVOH) that is impermeable to the pressurized fluid contained therein as disclosed in U.S. Pat. No. 6,082,025, which is incorporated by reference in its entirety. Each polymeric sheet 173, 175 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets 173, 175 may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the polymeric sheets 173, 175 are disclosed in U.S. Pat. Nos. 4,183,156 and 4,219,945 to Rudy which are incorporated by reference in their entireties. Further suitable materials for the polymeric sheets 173, 175 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the polymeric sheets 173, 175, engineering properties such as tensile strength, stretch properties, fatigue characteristics, dynamic modulus, and loss tangent can be considered. The thicknesses of polymeric sheets 173, 175 can be selected to provide these characteristics. In the article of footwear 110, the polymeric sheets 173, 175 are sufficiently transparent that the tether element 180 described herein is visible through the polymeric sheets 173, 175 from an exterior of the article of footwear 110, as indicated by the tensile elements 190 visible in FIGS. 15-16 and 19-23.

Referring to FIG. 18, the bladder 124 includes a tether element 180 spanning the fluid-filled chamber 172 from an inner surface 184 of the top polymeric sheet 173 of the bladder 124 to an inner surface 182 of the bottom polymeric sheet 175 of the bladder 124. The tether element 180 includes a top plate layer 185 secured to the lower inner surface 184 of the top polymeric sheet 173, such as with adhesive or thermal bonding. The tether element 180 further includes a bottom plate layer 187 bonded to the upper inner surface 182 of the bottom polymeric sheet 175. The tether elements 180 include a plurality of tensile elements 190 connected to the top plate layer 185 and to the bottom plate layer 187 and spanning the fluid-filled chamber 172. Each tensile element 190 shown in the side cross-sectional view of FIG. 18 represents a row of tensile elements 190 that extend laterally across the fluid-filled chamber 172, as is evident in FIGS. 15 and 16. Tensile elements 190 can provide desired responsiveness, such as disclosed in U.S. Pat. No. 8,479,412 to Peyton et al., which is incorporated by reference herein in its entirety. The tensile elements 190 are placed in tension when the fluid-filled chamber 172 is inflated, and limit the height of the inflated bladder 124 by preventing the polymeric sheets 173, 175 from ballooning apart beyond the combined height of the plate layers 185, 187 and a tensile element 190. In a non-limiting example, the bladder 124 may have a maximum height from the top side 152 to the bottom side 150 from about 8 millimeters to about 16 millimeters (mm) (e.g., 8 mm, 9 mm, 10 mm, 11 mm, 12 mm, 13 mm, 14 mm, 15 mm, or 16 mm) when the fluid-filled chamber 172 is inflated to an internal pressure of about 15 pounds per square inch (psi) to about 30 psi (e.g., 15 psi, 16 psi, 17 psi, 18 psi, 19 psi, 20 psi, 21 psi, 22 psi, 23 psi, 24 psi, 25 psi, 26 psi, 27 psi, 28 psi, 29 psi, or 30 psi). Force from an impact of the article of footwear 110 with the ground plane G compresses the fluid gas (e.g., air or nitrogen) in the fluid-filled chamber 172 and is dispersed over the inner surface area of the bladder element 124. Due to the ability of the fluid-filled chamber 172 to disperse force, the bladder element 124 functions similar to plate 24 of FIG. 1, and may be referred to as a plate.

Referring again to FIGS. 15, 16, and 19, the bladder 124 is disposed only in the extension portion 136, the forefoot portion 134, and partially in the midfoot portion 132 (indicated only by hidden lines in FIG. 17. As best shown in FIG. 17, the bladder 124 tapers in width in the midfoot portion 132. In FIGS. 19-22, a portion of the bladder 124 that extends in to the midfoot portion 132 is thus hidden by the resilient sole component 122 which is disposed laterally outward of that portion. The resilient sole component 122 overlies the bladder 124. In portions of the midfoot portion 132 and the heel portion 130 in which the bladder 124 does not extend, the resilient sole component 122 extends from the upper 114 to the outsole 170. The resilient sole component 122 is thus thicker in those areas rearward of the bladder 124. Alternatively, the resilient sole component 122 could be of uniform thickness from the extension portion 136 to the heel portion 130, and a separate cushioning component could underlie the resilient sole component 122 rearward of the bladder 124.

Referring to FIG. 19, the curvature C1 of the extension portion 136 is the same as the curvature of the forefoot portion 134. In other words, the curvature C1 of the extension portion 136 follows the side profile of the forefoot portion 134, and the extension portion 136 and the forefoot portion 134 have a substantially equal radius of curvature R, which may provide a seamless feel to a wearer in transitioning from loading on the forefoot portion 134 to loading at least partially on the extension portion 136 during a forward stride.

Figure 20:
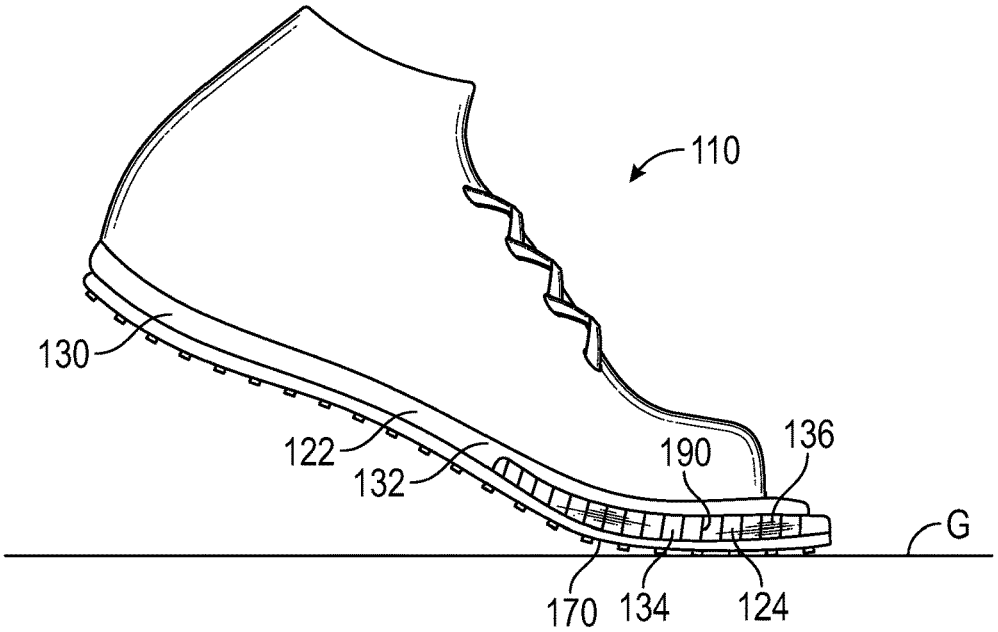
FIG. 20 is a schematic illustration in side view of the article of footwear of FIG. 15 at a first stage of motion.
Figure 21:
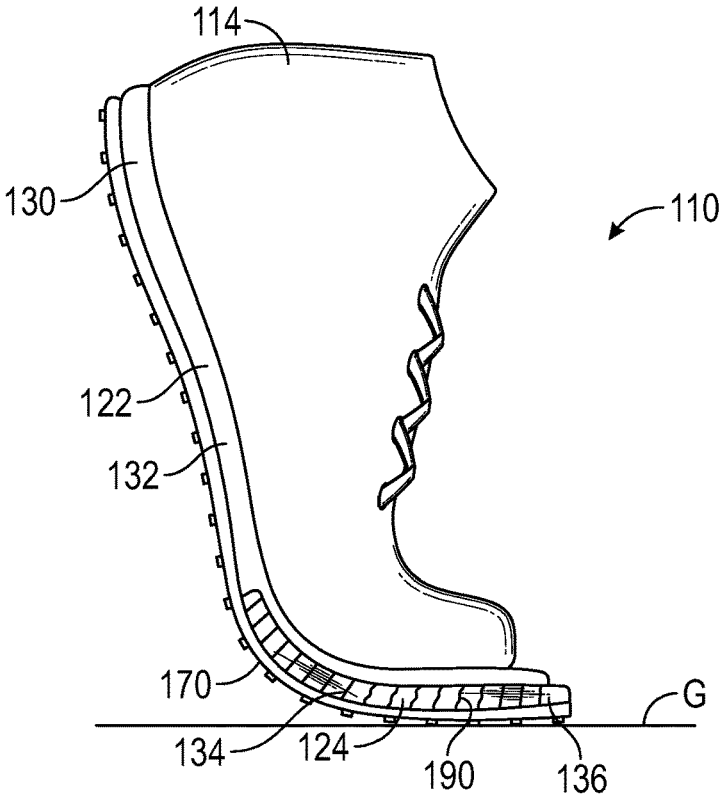
FIG. 21 is a schematic illustration in side view of the article of footwear of FIG. 15 at a second stage of motion.

FIGS. 19-22 show the article of footwear progressing through stages of motion during a forward stride. FIG. 19 shows the article of footwear 110 in a neutral or start position. FIG. 20 depicts a first stage of motion in which weight is shifted onto the forefoot portion 134 as the heel portion 130 is lifted from the level ground plane G during dorsiflexion. The outsole 170 is shown in contact with the ground plane G at both the extension portion 136 and the forefoot portion 134. In a second stage of motion shown in FIG. 21, a rear section of the forefoot portion 134 is lifted from the ground plane G along with the midfoot portion 132 and the heel portion 130, while a forward section of the forefoot portion 134 remains in contact with the ground plane G, along with the extension portion 136.

Figure 22:
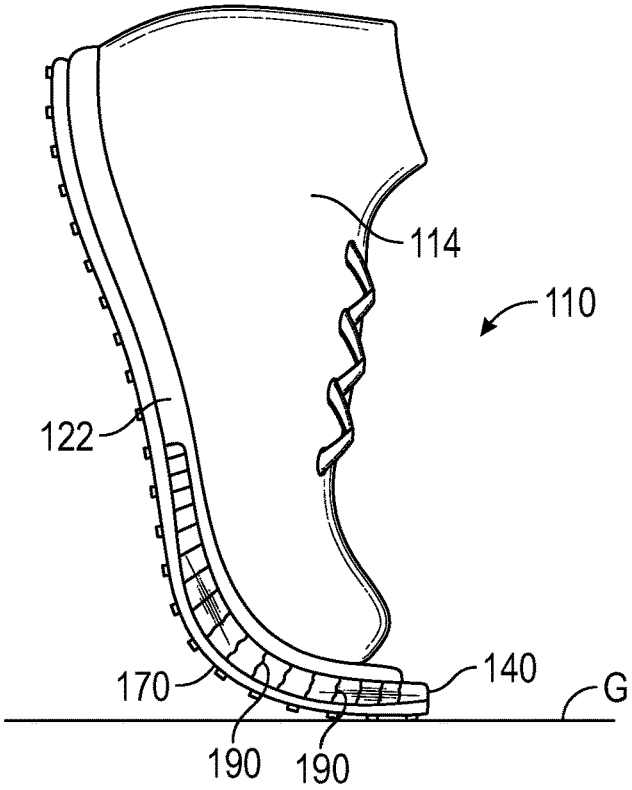
FIG. 22 is a schematic illustration in side view of the article of footwear of FIG. 15 at a third stage of motion.

A third stage of motion shown in FIG. 22 is a "toe-off" position, just prior to the article of footwear 110 being lifted completely out of contact with the ground plane G. The stiffness of the bladder 124 corresponds with its inflation pressure in the fluid chamber 172. A higher inflation pressure corresponds with a higher bending stiffness, and a lower inflation pressure corresponds with a lower bending stiffness. In the article of footwear 110, the inflation pressure is low enough to provide some compression in height of the fluid chamber 172 under loading, as indicated by the tension elements depicted in a somewhat slack state. The inflation pressure is also low enough to enable substantial bending along the length of the article of footwear 110 in the forefoot portion 134, allowing the extension portion 136 to remain in contact with the ground plane G at the third stage. The inflation pressure is great enough to act as a spring, resiliently returning the bladder 124 to its initial height prior to compression under loading. The bladder 124 bends at the forefoot portion 134 more readily than the plate 24 of the article of footwear 10, and does not pivot about the distal front end 140. Instead, more of the extension portion 136 stays in contact with the ground plane G over a greater range of flex angles during dorsiflexion in a forward stride both in comparison to a sole structure that terminates at the front edge of the forefoot portion 134 (i.e., has no extension portion 136), and in comparison to the extension portion 36 of FIG. 4, which is sufficiently stiff to lift from the ground plane G at the stage of motion shown in FIG. 4, and pivot about the distal front end 40. By increasing the surface area of the sole structure 112 to include surface area S2, the range of flex angles and duration over which forces are reacted by the sole structure 112 are increased, and cushioning (i.e., deceleration of the ground impact force) is provided for a greater duration.

Figure 23:
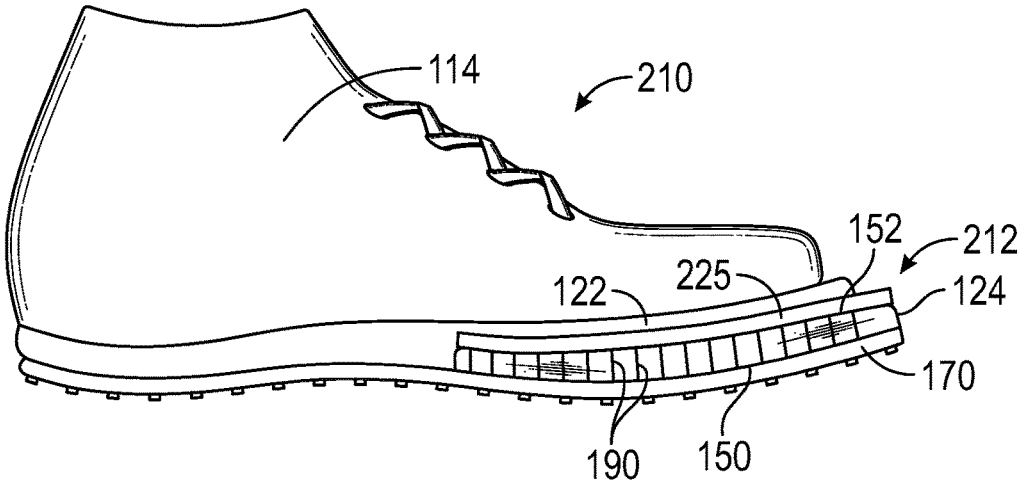
FIG. 23 is a schematic illustration in side view of an article of footwear with a sole structure that has an extension portion.

FIG. 23 shows another embodiment of an article of footwear 210 with a sole structure 212. The article of footwear 210 has many of the same components and functions the same as the article of footwear 110, except that the sole structure 212 includes an additional plate 225 that is disposed between the resilient sole component 122 and the bladder 124 in the forefoot portion 134 and the extension portion 136. The additional plate 225 extends at least partially in the extension portion 136 and is disposed adjacent the bladder 124 such that the addition plate 225 interfaces with the bladder 124, including during a forward stride. The additional plate 225 overlies the bladder element 124 and interfaces with an upper surface of the bladder 124 (i.e., the top side 152, which establishes and includes an outer surface and also an upper surface of the bladder 124). The additional plate 225 is sufficiently stiff to disperse a downward force on the plate 225 (such as due to the weight of the wearer shifting to the forefoot during a forward stride) evening out the distribution of the force over the top side 152 of the bladder 124. The additional plate 225 may be any of a variety of materials selected to provide a desired bending stiffness. Non-limiting examples of materials suitable for the additional plate 225 include any one of carbon fiber, spring steel, fiberglass, nylon, a thermoplastic elastomer, such as polyether block amide, or a superelastic metal including nitinol. One example polyether block amide is commercially available under the tradename PEBAX®, from Arkema Inc. in King of Prussia, Pa. USA. The additional plate 225 may have a greater compressive stiffness than the resilient sole component 122, and may have a lower bending stiffness, the same bending stiffness, or a greater bending stiffness than the bladder element 124.

Figure 24:
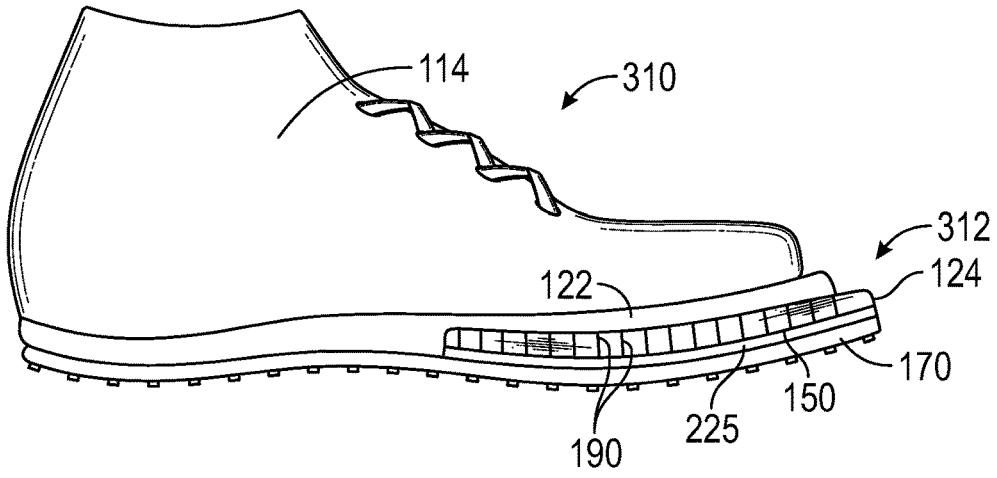
FIG. 24 is a schematic illustration in side view of an article of footwear with a sole structure that has an extension portion.

FIG. 24 shows another embodiment of an article of footwear 310 with a sole structure 312. The article of footwear 310 has many of the same components and functions the same as the article of footwear 210, except in the sole structure 312, the additional plate 225 is disposed between the bladder 124 and the outsole 170 in the forefoot portion 134 and the extension portion 136. The additional plate 225 extends at least partially in the extension portion 136 and is disposed adjacent the bladder 124 such that the addition plate 225 interfaces with the bladder 124, including during a forward stride. The bladder 124 overlies the additional plate 225 so that the additional plate 225 interfaces with a lower surface of the bladder 124 (i.e., the bottom side 150, which establishes and includes an outer surface and also a lower surface of the bladder 124). The plate 225 may advantageously distribute ground reaction forces over the bottom side 150 of the bladder 124. Because both the cushioning component 122 and the bladder element 124 come between a foot supported on the sole structure 312 in the upper 114 and the additional plate 225, and the cushioning component 122 is more compressible than either of the bladder 124 and the plate 225, the sole structure 312 may have a more cushioned feel to the foot than the sole structure 212.

Figure 25:
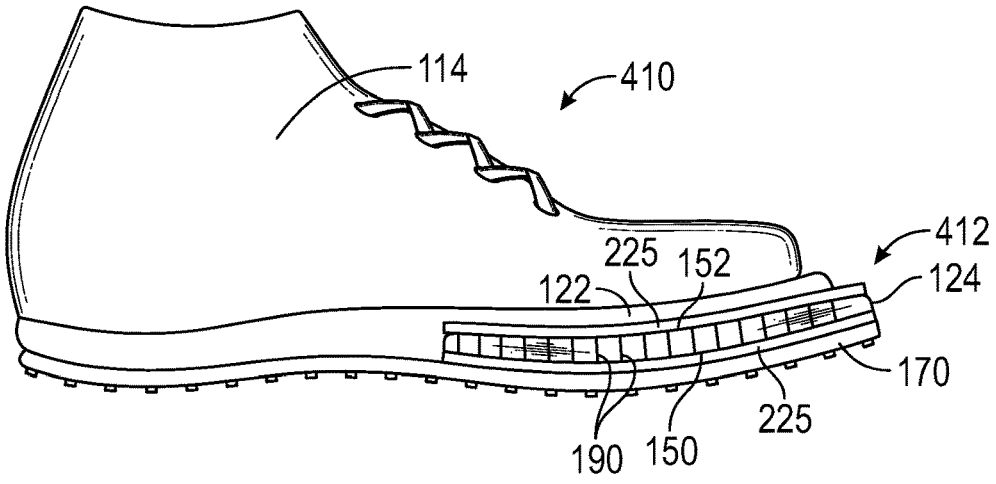
FIG. 25 is a schematic illustration in side view of an article of footwear with a sole structure that has an extension portion.

FIG. 25 shows another embodiment of an article of footwear 410 with a sole structure 412. The article of footwear 410 has many of the same components and functions the same as the articles of footwear 210 and 310, except the sole structure 412 includes two additional plates 225, one disposed between the bladder 124 and the cushioning component 122 (i.e., overlying the bladder 124) as in FIG. 23, and one disposed between the bladder 124 and the outsole 170 in the forefoot portion 134 and the extension portion 136 (i.e., underlying the bladder 124 as in FIG. 24).

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

What is claimed is:

1. An article of footwear comprising:

an upper having a forefoot region with a foremost extent;

a sole structure having a forefoot portion underlying the forefoot region of the upper, and an extension portion extending forward from the forefoot portion;

wherein the extension portion extends forward of the foremost extent of the upper from a forward edge of the forefoot portion to a distal end, and a top side of the extension portion is exposed and spaced apart from the upper from the forward edge of the forefoot portion to the distal end;

wherein the extension portion establishes a propulsion surface forward of the foremost extent of the upper during a forward stride; and wherein the sole structure includes a resilient sole component disposed between the upper and the extension portion and extending forward of the upper on the top side of the extension portion.

2. The article of footwear of claim 1, wherein the forward edge of the forefoot portion has a first width, and the extension portion has a second width greater than the first width.

3. The article of footwear of claim 1, wherein the extension portion extends forward beyond a forward-most extent of the resilient sole component.

4. The article of footwear of claim 1, wherein the resilient sole component is an elastic foam midsole.

5. The article of footwear of claim 1, wherein the sole structure further comprises:

an outsole underlying the extension portion; wherein the outsole has a ground contact surface that includes the propulsion surface.

6. An article of footwear comprising:

an upper having a forefoot region with a foremost extent;

a sole structure having a forefoot portion underlying the forefoot region of the upper, and an extension portion extending forward from the forefoot portion;

wherein the extension portion extends forward of the foremost extent of the upper from a forward edge of the forefoot portion to a distal end, and a top side of the extension portion is exposed and spaced apart from the upper from the forward edge of the forefoot portion to the distal end;

wherein the extension portion establishes a propulsion surface forward of the foremost extent of the upper during a forward stride; and wherein the sole structure includes a bladder having a fluid-filled chamber disposed at least partially in the extension portion.

7. The article of footwear of claim 6, wherein the bladder includes a tether element spanning the fluid-filled chamber from a lower inner surface of the bladder to an upper inner surface of the bladder.

8. The article of footwear of claim 6, wherein the bladder is disposed at least partially in the forefoot portion of the sole structure and extends laterally outward of a lateral side of the upper in the forefoot region and medially outward of a medial side of the upper in the forefoot region.

9. The article of footwear of claim 6, wherein:

the sole structure has a midfoot portion rearward of the forefoot portion, and a heel portion rearward of the midfoot portion; and the bladder extends only in the midfoot portion, the forefoot portion, and the extension portion.

10. The article of footwear of claim 6, wherein the sole structure includes a plate extending at least partially in the extension portion and disposed adjacent the bladder such that the plate interfaces with the bladder during the forward stride.

11. The article of footwear of claim 10, wherein the plate underlies the bladder and interfaces with a lower surface of the bladder.

12. The article of footwear of claim 10, wherein the plate overlies the bladder and interfaces with an upper surface of the bladder.

13. The article of footwear of claim 1, wherein the extension portion and the forefoot portion have a substantially equal radius of curvature along a length of the sole structure when the article of footwear is not in use.

14. An article of footwear comprising:

an upper having a forefoot region with a foremost extent;

a sole structure having a forefoot portion underlying the forefoot region of the upper, and having an extension portion extending forward of a forward-most extent of the upper from a forward edge of the forefoot portion to a distal end, wherein:

the extension portion includes a bladder, a top plate overlaying the bladder, a bottom plate underlying the bladder, and a resilient sole component;

the top plate has a top side and a bottom side opposite the top side;

the top side is nearer to the upper than the bottom side;

the resilient sole component is disposed between the upper and the top side of the top plate and extends forward of the foremost extent of the upper on the top side of the top plate;

the top plate, the bottom plate, and the bladder extend forward of the foremost extent of the upper; and the extension portion establishes a ground-contacting propulsion surface forward of the foremost extent of the upper during a forward stride.

15. The article of footwear of claim 14, wherein the forward edge of the forefoot portion has a first width, and the extension portion has a second width greater than the first width.

16. The article of footwear of claim 14, wherein the sole structure includes an outsole on the bottom side of the bottom plate and underlying the extension portion, and wherein the outsole has a ground contact surface that includes the propulsion surface.

17. The article of footwear of claim 14, wherein the bladder encloses a fluid-filled chamber disposed at least partially in the extension portion.

18. The article of footwear of claim 17, wherein the bladder includes a tether element entirely within the fluid-filled chamber and spanning the fluid-filled chamber from a lower inner surface of the bladder to an upper inner surface of the bladder.

19. The article of footwear of claim 14, wherein the bladder is disposed at least partially in the forefoot portion of the sole structure and extends laterally outward of a lateral side of the upper in the forefoot region and medially outward of a medial side of the upper in the forefoot region.

20. The article of footwear of claim 14, wherein:

the sole structure has a midfoot portion rearward of the forefoot portion, and a heel portion rearward of the midfoot portion; and the bladder extends only in the midfoot portion, the forefoot portion, and the extension portion.

21. The article of footwear of claim 14, wherein the resilient sole component is an elastic foam midsole.

22. The article of footwear of claim 14, wherein the extension portion and the forefoot portion have a substantially equal radius of curvature along a length of the sole structure when the article of footwear is not in use.

23. An article of footwear comprising:

an upper having a forefoot region with a foremost extent;

a sole structure having a forefoot portion underlying the forefoot region of the upper, and an extension portion extending forward from the forefoot portion;

wherein:

the extension portion includes a bladder and a plate adjacent the bladder and interfacing with an outer surface of the bladder;

the extension portion extends forward of the foremost extent of the upper from a forward edge of the forefoot portion to a distal end, the upper is secured to a top side of the sole structure in the forefoot portion, and the top side continues forward from the forefoot portion in the extension portion and is spaced apart from the upper from the forward edge of the forefoot portion to the distal end; and the extension portion establishes a propulsion surface forward of the foremost extent of the upper during a forward stride.

24. The article of footwear of claim 23, wherein the plate overlies the bladder and the outer surface is an upper surface of the bladder.

25. The article of footwear of claim 23, wherein the bladder overlies the plate and the outer surface is a lower surface of the bladder.

26. The article of footwear of claim 23, wherein the plate is a first plate that overlies the bladder, the outer surface is a lower surface of the bladder, and the sole structure includes a second plate extending at least partially in the extension portion adjacent the bladder with the bladder overlying the second plate and the second plate interfacing with a lower surface of the bladder.

* * * * *